US006535173B2

(12) United States Patent
Ou

(10) Patent No.: US 6,535,173 B2
(45) Date of Patent: Mar. 18, 2003

(54) SLOT ARRAY ANTENNA HAVING A FEED PORT FORMED AT THE CENTER OF THE REAR SURFACE OF THE PLATE-LIKE STRUCTURE

(75) Inventor: Hok Huor Ou, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/995,571

(22) Filed: Nov. 29, 2001

(65) Prior Publication Data

US 2002/0101385 A1 Aug. 1, 2002

(30) Foreign Application Priority Data

Jan. 29, 2001 (JP) ..... 2001-019945

(51) Int. Cl.[7] ..... H01Q 13/10
(52) U.S. Cl. ..... 343/770; 343/771
(58) Field of Search ..... 343/770, 767, 343/768, 771; H01Q 13/10

(56) References Cited

U.S. PATENT DOCUMENTS 5,726,666 A * 3/1998 Hoover et al. ..... 343/770
5,757,329 A * 5/1998 Hoover et al. ..... 343/770
6,028,562 A * 2/2000 Guler et al. ..... 343/771
6,124,833 A * 9/2000 Bialkowski et al. ..... 343/770
6,285,335 B1 * 9/2001 Snygg et al. ..... 343/770

OTHER PUBLICATIONS

"Fundamentals and Applications of Millimeter–Wave Technologies" Realize, Inc, Tokyo, Japan, pp., 140–184, Jul. 31, 1998.

* cited by examiner

*Primary Examiner*—Hoanganh Le
(74) *Attorney, Agent, or Firm*—Venable; Michael A. Sartori; John H. Kim

(57) ABSTRACT

A slot array antenna includes a feed waveguide plate, a radiating waveguide plate and a slot plate adhered or connected together. The feed waveguide plate is formed with a first feed port and a feed waveguide to which an electromagnetic wave is fed via the feed port. The radiating waveguide plate is formed with second feed ports communicated to the feed waveguide, and radiating waveguides communicated to the second feed ports. The slot plate is formed with slots for radiating electromagnetic waves fed via the radiating waveguides. The first feed port is positioned substantially at the center of the length of the feed waveguide. The slot array antenna allows a polarization direction of the antenna to be freely adjusted while minimizing a wasteful space otherwise allotted to peripheral circuits and is therefore miniaturized.

23 Claims, 12 Drawing Sheets

SLOT ARRAY ANTENNA HAVING A FEED PORT FORMED AT THE CENTER OF THE REAR SURFACE OF THE PLATE-LIKE STRUCTURE

BACKGROUND OF THE INVENTION

1. Field of the Invention

The present invention relates to a slot array antenna and more particularly to the arrangement of a feed port formed in a slot array antenna.

2. Description of the Background Art

Generally, an array antenna has a plurality of antenna elements or segments arranged in a certain pattern for acquiring characteristics impractical with a single antenna. Further, by regulating the respective antenna elements in phase, it is possible to control the directivity of the entire array antenna.

Today, frequency bands allocated to a variety of communication apparatuses are becoming short due to the remarkable development of radio transmission technologies. To make up for short frequency bands, it is necessary to more effectively use frequencies and to further shift frequencies to a higher range. Technologies meeting such requisites are therefore an urgent issue. Recently, a millimeter wave, for example, that has not been taken into consideration except for fundamental studies is planned for the application to ITS (Intelligent Transport System). In motorized societies, millimeter-wave transmission apparatuses are expected to be used as popularly as household appliances in the near future.

Under the above circumstances, the application of various parts and devices to the millimeter-wave range is, of course, necessary in the millimeter-wave transmission field. An antenna is one of the most important devices for millimeter-wave transmission systems. Millimeter transmission systems are not practicable without an antenna capable of transmitting and receiving millimeter-wave signals. Today, research institutions and manufacturers joining in the worldwide study and development of millimeter-wave transmission systems are competing with each other for high performance millimeter-wave antennas. While some different millimeter-wave antennas have already been proposed, one of them featuring high performance is a slot array antenna.

The slot array antenna is made up of a plurality of conventional slot antennas or antenna elements arranged in a certain pattern. The slot antennas are sized and arranged in a particular pattern implementing a desired electric field distribution in a certain region. For example, the type of slot antennas arranged bidimensionally in a rectangular region can have an electric field which distributes uniformly in direction, phase and amplitude. Theoretically, the slot array antenna is substantially the same in radiation characteristics as the aperture antenna having a uniform electric field distribution. However, the slot array antenna is superior to the aperture antenna when it comes to the freedom of configuration and the uniformity of the electric field distribution.

FIG. 1 shows the basic configuration of a conventional, bidimensional array antenna. As shown, the array antenna includes feed port or signal generator 20 and antenna elements or segments 21. Transfer paths 22 connect the feed port 20 with antenna elements 21. At the same time, the transfer paths 22 play the role of phase shifters. More specifically, each of the transfer paths 22 determines the phase of an electromagnetic wave to be radiated from one of the antenna elements 21 associated therewith, and has critical influence on the radiation characteristics of the entire array antenna. To further adjust the phases, additional phase shifters may serially be arranged on respective transfer paths, as the case may be.

FIG. 2 shows a specific configuration of a slot array antenna using a single, rectangular waveguide tube. As shown, the slot array antenna includes a waveguide 31 formed with slots 32 in one of the walls thereof. Usually, each slot 32 has its length that is equal to about one-half of the wavelength $\lambda$ of an electromagnetic wave input to the waveguide 31, and its width that is equal to about one-twentieth of the wavelength $\lambda$. In the specific configuration, when the waveguide 31 is driven in the dominant mode $TE_{10}$, the magnetic and electric fields are distributed in the directions of the length and the width of the slots 32, respectively.

The electromagnetic wave mode referred to in the present specification is the dominant mode $TE_{10}$ unless otherwise stated explicitly. Generally, as shown in FIG. 2, the pitch between the slots 32 spaced in the longitudinal direction of the waveguide 31 is equal to about one-half of the guide wavelength $\lambda g$. The pitch between the nearby slots 32 aligned in each of the longitudinal lines, or slot arrays, is substantially equal to the guide wavelength $\lambda g$.

A desired distribution of electromagnetic fields can be set up to some extent on the outer wall 33 of the waveguide if the dimensions and position of the slots 32 cut in the wall 33 are appropriately adjusted. Such a slot array antenna is monodimensional. By arranging a plurality of slot array antennas in parallel, each of which has the configuration shown in FIG. 2, there can be implemented a bidimensional slot array antenna. Today, a bidimensional slot array antenna is recognized as one of high-gain antennas theoretically and experimentally, as discussed in a Japanese document, "Fundamentals and Applications of Millimeter-Wave Technologies", REALIZE INC., Tokyo, Japan, pp. 140–184, Jul. 31, 1998.

FIG. 3 shows a conventional, bidimensional slot array antenna in an exploded view. A bidimensional, slot array antenna will be simply referred to as a slot array antenna hereinafter unless stated otherwise. As shown, the slot array antenna is generally made up of a slot plate 411 and a waveguide plate 412 forming waveguides. Generally, the slot plate 411 is implemented by a thin, electro-conductive plate and formed with a plurality of slots 421, see FIG. 4. The plate 412 is a relatively thicker, electro-conductive plate having rectangular-cross-sectional grooves formed therein. The grooves are configured such that an input electromagnetic wave can be fed from a single feed port to all of the slots 421 of the slot plate 411. More specifically, when the slot plate 411 is laid on and adhered to the plate 412 into an assembly, the arrays of slots are positioned right above the grooves associated therewith with parts of the plate 411 forming the walls of waveguides established by those grooves. In this arrangement, the entire assembly operates as a slot array antenna. The higher the conductivity of the conductors constituting the slot plate 411 and the plate 412, the smaller the ohmic loss of the entire antenna. Further, the accuracy in assembly and adhesion of the slot plate 411 with the plate 412 noticeably influences on the radiation characteristics of the resultant antenna.

As shown in FIG. 4, while each slot 421 formed in the slot plate 411 is basically rectangular, its opposite ends are sometimes rounded for manufacturing reasons. Each slot 421 has its length that is equal to about one-half of the wavelength of an electromagnetic wave to be radiated, and its width that is equal to about one-twentieth of the same, as stated earlier. The pitch between the nearby slots 421 on the same array is substantially equal to the guide wavelength λg.

As seen in FIG. 5, the plate 412 has a feed port 431 cut therein. When the slot plate 411 and plate 412 are adhered together into assembly, a portion 432 indicated by a dashed ellipse in FIG. 5 constitutes an H plane tee junction as referred to in the art of microwave circuit devices. An electromagnetic wave input via the feed port 431 is split into two at the H plane tee junction 432 in the opposite directions perpendicular to each other. The resulting two electromagnetic waves are of the same phase as to power.

A matching lug or post 433 plays the role of a matching stub included in a conventional H plane tee junction. The lug or post 433 protrudes toward the feed port 431, as seen in FIG. 5. A groove extending in the opposite directions from the H plane tee junction 432 constitutes a waveguide when the slot plate 411 and plate 412 are adhered together. Let this waveguide be referred to as a feed waveguide. Because the feed waveguide is symmetrical in the opposite directions with respect to the longitudinal axis of the feed port 431, the following description will concentrate only on one side of the plate 412 for the sake of simplicity.

Second feed ports 434 communicate the feed waveguide to a plurality of radiating waveguides 437. Each of the feed ports 434 has a sectional area substantially equal to the sectional area of the feed waveguide. Lugs or posts 435 protrude from the portions of the wall of the feed waveguide that face the feed ports 434, serving as matching stubs. The distance between the beginning of the feed waveguide to the last feed port 434 is selected to be equal to about one-fourth of the guide wavelength λg in order to suppress reflections.

The radiating waveguides 437 extend from the feed waveguide in the direction perpendicular to the latter via the second feed ports 434. Radiating waveguides 437 adjacent to each other are isolated from each other by a wall 436. The wall 436 splits the electromagnetic wave input via one feed port 434 adjoining it into two, so that the resulting two waves each are input to one of the two radiating waveguides 437. When the slot plate 411 and plate 412 are adhered together into assembly, each of the slot arrays positions above associated one of the radiating waveguides 437, thus functioning as the monodimensional array antenna shown in FIG. 2.

In the structure described above, the number of the radiating waveguides 437 constituting the conventional slot array antenna is a multiple of "4" without exception. If desired radiation characteristics and frequency to be used are determined, then the approximate number of radiating waveguides and that of slots to be positioned above each radiating waveguide are determined, determining the approximate size of the entire antenna.

FIG. 6 shows the slot array antenna, when assembled, having the slot plate and the waveguide plate adhered together. Because the electromagnetic wave mode inside the radiating waveguides is the dominant mode $TE_{10}$, the magnetic and electric fields respectively extend in the lengthwise and widthwise directions of the slots. In FIG. 6, arrows 51 and 52 respectively indicate the directions of the magnetic and electric fields of the entire antenna. All the slots are oriented in the same direction, so that the electric fields around the primary surface of the antenna, except for the edges of the antenna, extend substantially in the direction 52. In this sense, the direction 52 may generally be representative of the direction of the polarized waves for the antenna.

While the characteristics of an antenna are generally required higher in gain and lower in side lobe level, the width and the polarization direction of a main beam and so forth are sometimes strictly restricted as well, depending on an application. For example, an anti-collision radar system expected to be mounted on a motor vehicle in the near future needs a couple of slot array antennas each having the above-described structure, one for transmitting and the other for receiving. The slot array antennas work in the linear polarization mode to both transmit and receive waves polarized in the same direction. Therefore on a motor vehicle, the transmitter and receiver antennas should only be mounted in the same position.

However, for example, assume that a first motor vehicle with a type of transmitter and receiver antennas meets on a road a second motor vehicle with the same type of transmitter and receiver antennas, but running in the opposite directions to each other. Then, when the first motor vehicle receives radio waves, it cannot separate the radio wave transmitted by itself and reflected by the second motor vehicle from another radio wave generated by the second motor vehicle. This problem occurs when the radio waves emanating from both anti-collision radar systems are polarized vertically and/or horizontally.

By contrast, if the slot array antennas are mounted on the first and second motor vehicles so that the polarization plane of the radio waves, and hence the body of the slot array antennas, is inclined by 45° relative to the vertical or horizontal direction, then the polarization planes of the radio waves radiated from both motor vehicles are perpendicular to each other. The receiver antennas may therefore be mounted in the same manner as the transmitter antennas on the first and second motor vehicles, thus preventing each of the vehicles from receiving the radio waves radiated from the other. It follows that both of the transmitter and receiver antennas of the anti-collision radar system must be inclined by 45°.

In the conventional configuration, however, the first feed port 431 opens in one of the end faces of the plate 412, as shown in FIG. 5. As a result, when the on-board antenna is positioned such that the polarization direction is inclined by 45° relative to the vertical or horizontal direction, the feed port, which is present in the above position and therefore must be inclined as well, obstructs the miniaturization of the anti-collision radar system. More specifically, the inclination of the feed port requires even its peripheral circuits including a feed circuit connected to the feed port to be rotated or skewed, thus requiring an additional space for accommodating the peripheral circuits, which must be skewed correspondingly.

SUMMARY OF THE INVENTION

It is an object of the present invention to provide a slot array antenna in which the polarization direction may freely be varied while requiring a minimum of additional space.

In accordance with the present invention, a slot array antenna has a feed port formed substantially at the center of the rear surface of the body of the antenna. More specifically, a slot array antenna having a plate-like structure includes a first feed port via which an electromagnetic wave is input, a feed waveguide for distributing the electromagnetic wave input via the first feed port, an array of second feed ports to which a particular electromagnetic wave distributed by the feed waveguide is input, and arrays of radiating waveguides to each of which the particular electromagnetic wave is fed. The first feed port is positioned substantially at the center of the length of the feed waveguide, preferably substantially at the center of one of opposite major surfaces of the plate-like structure.

Also, in accordance with the present invention, a slot array antenna includes a feed waveguide plate of electro-conductive material formed with a first feed port to which an electromagnetic wave is input, and a feed waveguide for distributing the electromagnetic wave input via the first feed port. A radiating waveguide plate of electro-conductive material is formed with an array of second feed ports to each of which a particular electromagnetic wave distributed by the feed waveguide is input, and arrays of radiating waveguides each being communicated to one of the second feed ports for receiving the particular electromagnetic wave. A slot plate of electro-conductive material is formed with arrays of slots for radiating the electromagnetic waves input via the radiating waveguides. The first feed port is positioned substantially at the center of the length of the feed waveguide. The feed waveguide plate has its front surface connected to the rear surface of the radiating waveguide plate while the radiating waveguide plate has its front surface connected to the rear surface of the slot plate.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENT

Briefly, a slot array antenna embodying the present invention is generally made up of a feed waveguide plate, a radiating waveguide plate, and a slot plate, which are prepared independently of each other, positioned, and then connected together into assembly. To connect the three plates, there may be used screws, electro-conductive adhesive, welding or the like. In the illustrative embodiment, any desired connecting method may be used so long as the three plates are fully electrically and mechanically connected and free from defective connection that would deteriorate antenna characteristics. For example, a connecting method ascribable to clearance between the plates or an excessive amount of adhesive should be avoided.

Figure 7:
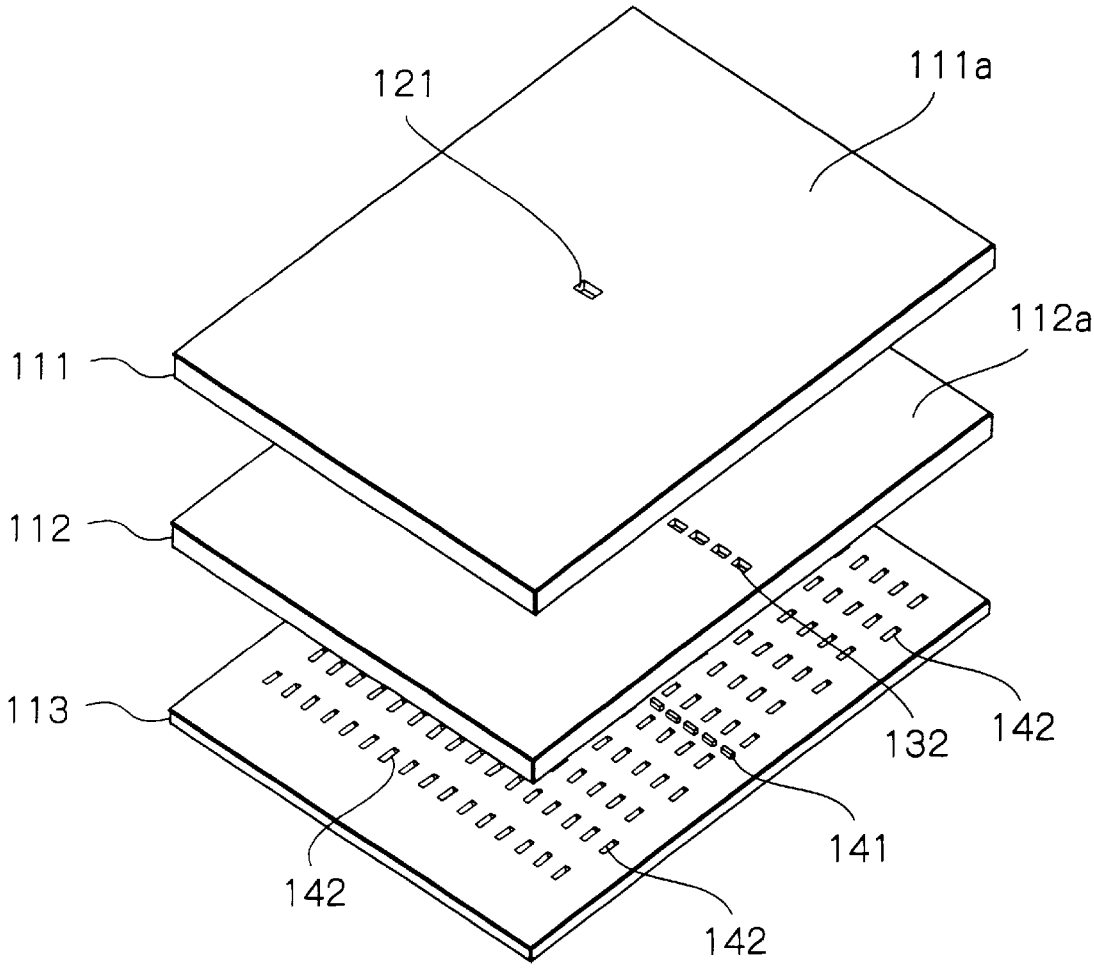
FIG. 7 is an exploded perspective view showing an embodiment of a slot array antenna in accordance with the present invention, as seen from the rear side thereof.
Figure 8:
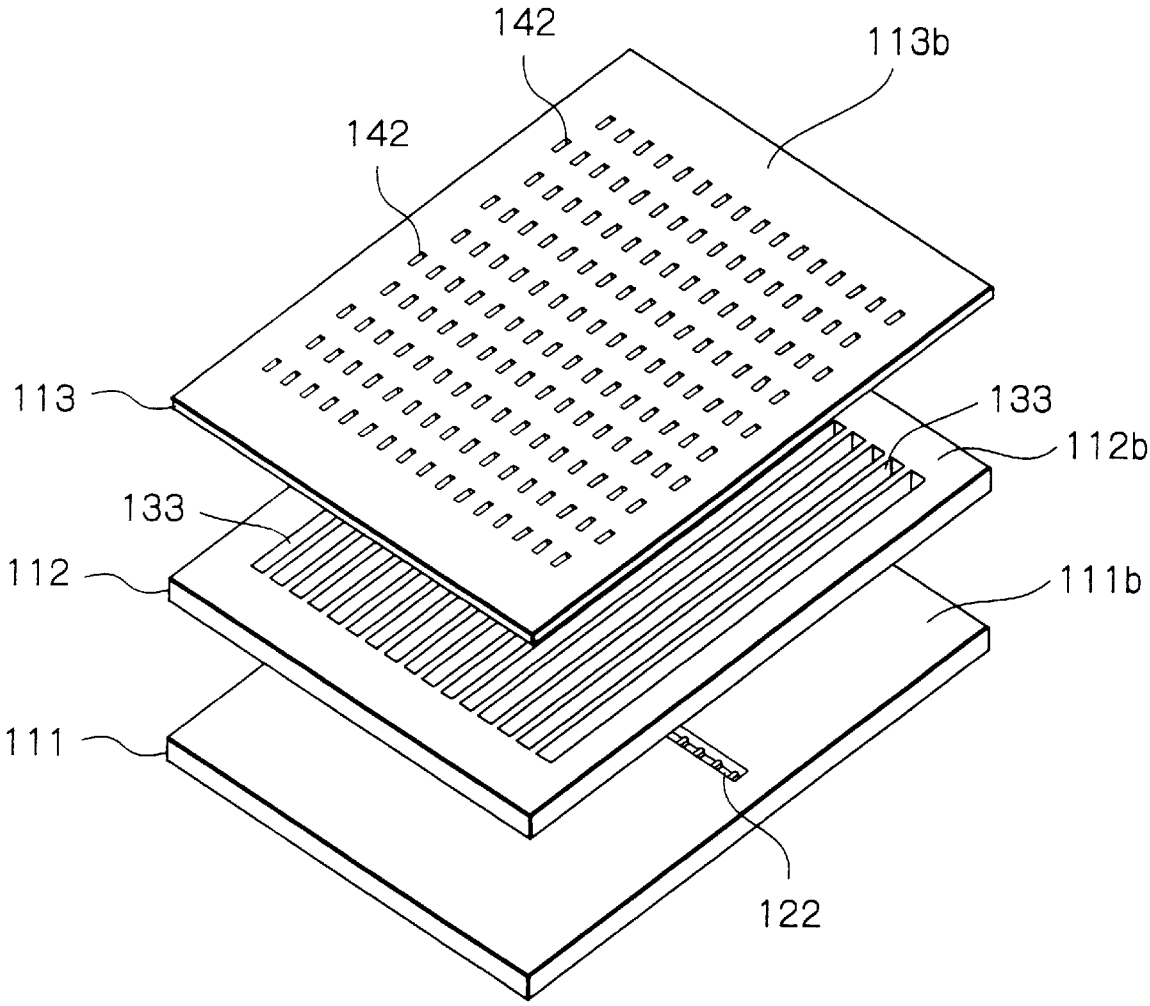
FIG. 8 is an exploded perspective view, similar to FIG. 7, showing the illustrative embodiment as seen from the front side thereof.
Figure 19:
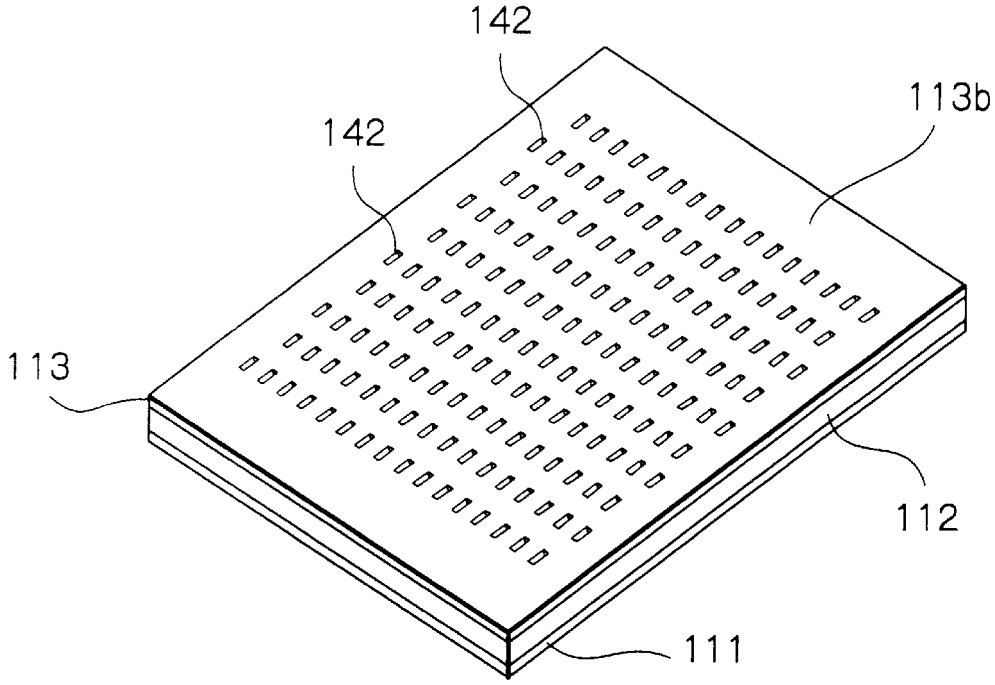
FIG. 19 shows in a perspective view the front side of the slot array antenna of the embodiment when assembled.
Figure 20:
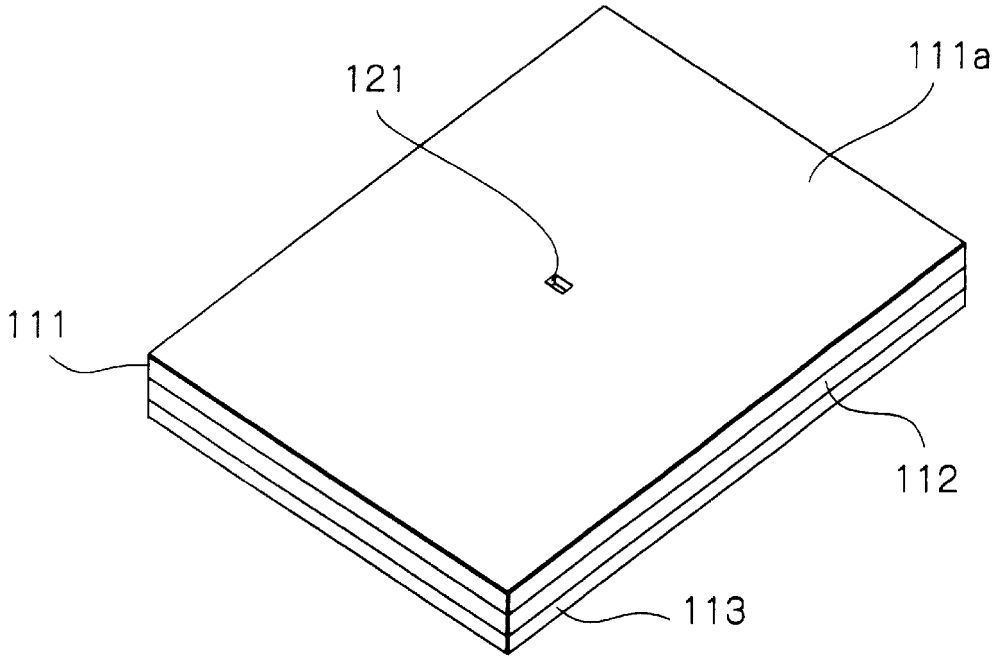
FIG. 20 shows in a perspective view, similar to FIG. 19, the rear side of the slot array antenna of the embodiment when assembled.

Specifically, as shown in FIGS. 7 and 8, a preferable embodiment of the slot array antenna in accordance with the present invention includes a feed waveguide plate 111, a radiating waveguide plate 112 and a slot plate 113, which are laid one above the other and to be connected or bonded together into assembly, as shown in FIGS. 19 and 20, by any suitable connecting method described above. FIG. 7 shows the antenna in an exploded perspective view as seen from its rear side. FIG. 8 shows the antenna also in an exploded perspective view as seen from its front side. All those plates 111, 112 and 113 are made of a generally flat, electrically conductive sheet or board of material, such as copper, and are of a generally rectangular shape having the substantially same shape as each other except for the thickness thereof. The plates 111, 112 and 113 may however have the primary surfaces of polygonal, round or any shapes other than a rectangle.

Figure 9:
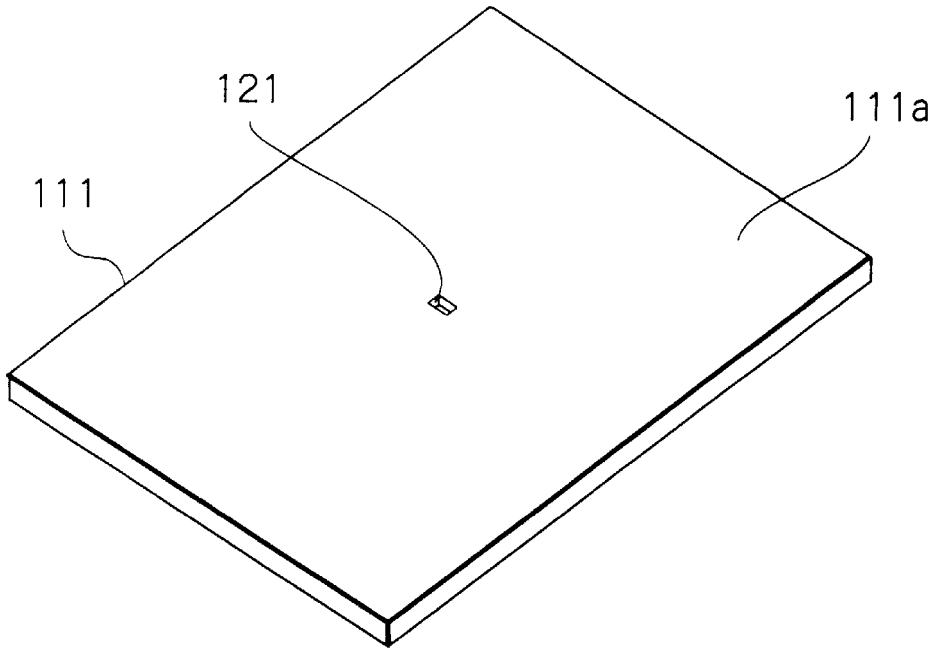
FIG. 9 is a perspective view showing the feed waveguide plate included in the illustrative embodiment, as seen from the rear side thereof.

FIG. 9 shows the rear, primary surface 111*a* of the feed waveguide plate 111. As shown, the feed waveguide plate 111 has a first feed port 121 formed at the center thereof and extending throughout the plate 111 generally perpendicularly to the rear surface 111*a*. When the antenna is used in operation, the feed port 121 is connected to a rectangular feed waveguide not shown. An electromagnetic wave is fed from an outside feed circuit through the feed waveguide to the first feed port 121. For that aim, the feed port 121 is therefore shaped and dimensioned in the same manner as the open end of the rectangular waveguide tube. In order to connect the feed port 121 to the rectangular waveguide tube, screw holes and positioning pins are positioned around the feed port 121 although not shown specifically.

Figure 10:
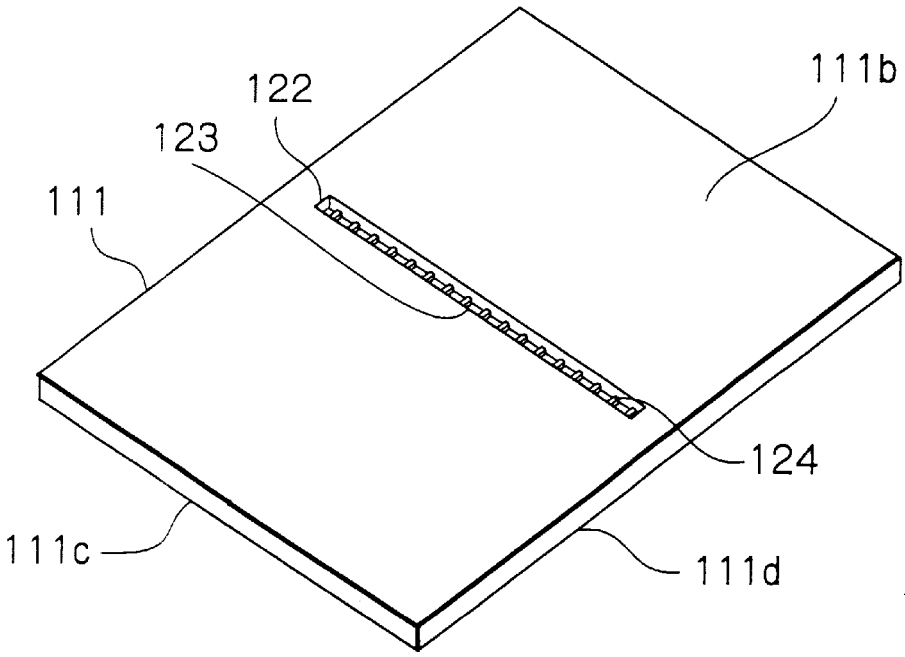
FIG. 10 is a perspective view, similar to FIG. 9, showing the feed waveguide plate as seen from the front side thereof.
Figure 11:
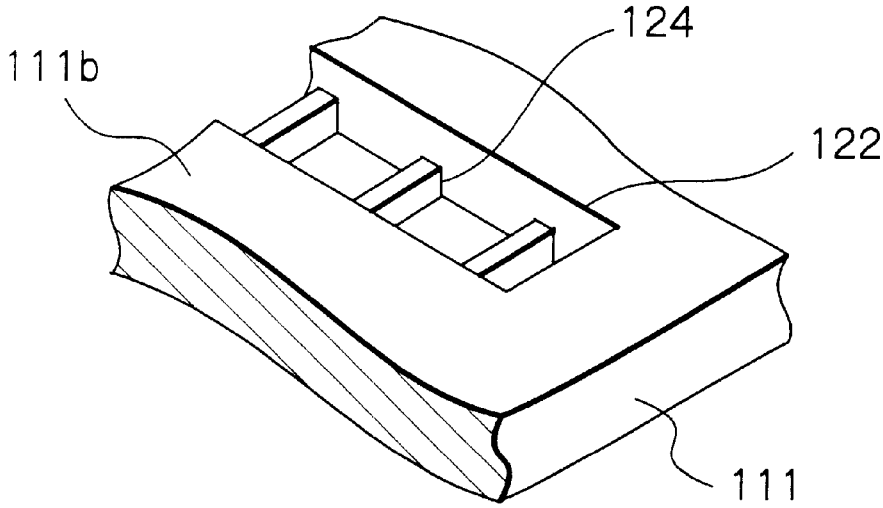
FIG. 11 shows, in a perspective view, a portion cutout from the feed waveguide plate shown in FIG. 10.

FIG. 10 shows the front, primary surface 111*b* of the feed waveguide plate 111. As shown, in the particular embodiment a feed waveguide 122 is formed in the front surface of the feed waveguide plate 111 to run in a direction substantially parallel to the shorter edge 111*c* of the rectangular shape for distributing the electromagnetic wave input via the first feed port 121. Alternatively, the feed waveguide 122 may be formed to run in a direction substantially parallel to the longer edge 111*d*. The feed port 121 is positioned at the intermediate, preferably center, between the opposite ends of the feed waveguide 122. The portion where the feed port 121 communicating with the rear surface 111*a* and the feed waveguide 122 running along the front surface 111*b* join each other constitutes an H plane tee junction 123. The feed waveguide 122, which is symmetrical in the opposite direction parallel to the shorter edge 111*c* with respect to the feed port 121, splits the input electromagnetic wave into two. The feed waveguide 122 may be formed perpendicularly to the shorter edge 111*c*. Posts 124 protrude from the bottom of the feed waveguide 122 as more specifically seen in FIG. 11 such that they each face one of second feed ports 132, FIG. 12, formed in the radiating waveguide plate 112, as will be described specifically later. The posts 124 play the role of matching stubs for matching the second feed ports 132 and are equal in number to the feed ports 132.

Figure 12:
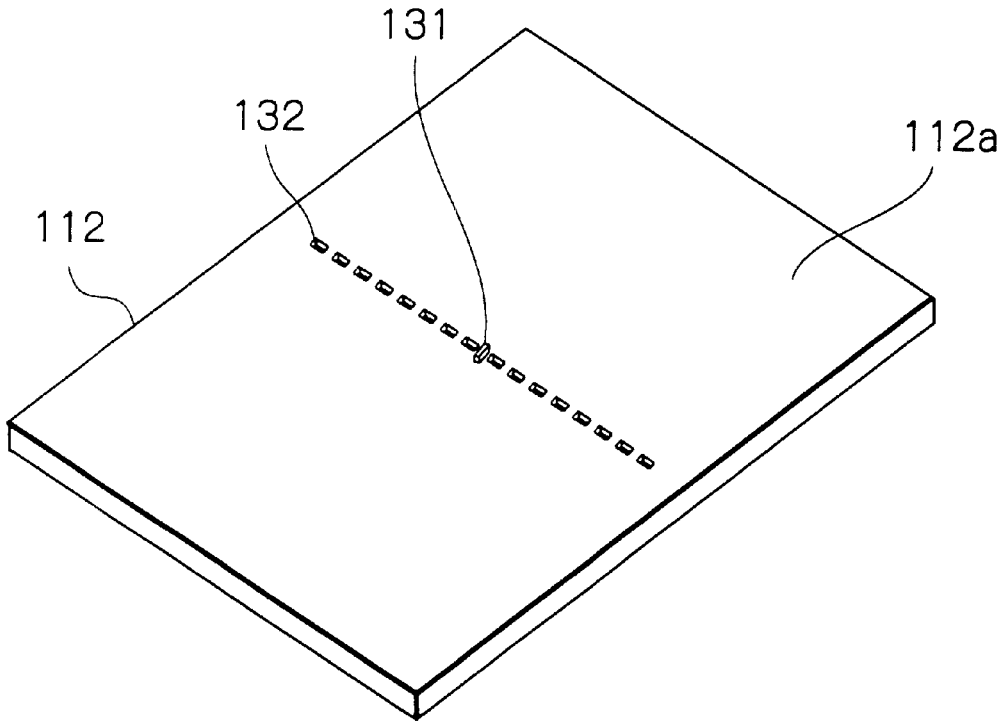
FIG. 12 is a perspective view of the radiating waveguide plate also included in the illustrative embodiment, as seen from the rear side thereof.
Figure 13:
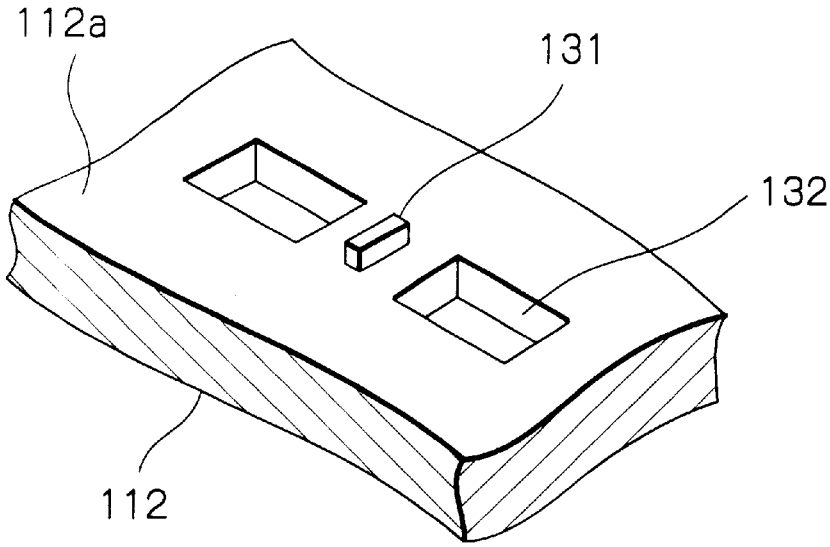
FIG. 13 shows, also in a perspective view, a portion cutout from the radiating waveguide plate shown in FIG. 12.

FIG. 12 shows the rear, primary surface 112*a* of the radiating waveguide plate 112. As shown, the radiating waveguide plate 112 has an array of second feed ports 132 cut into the radiating waveguide plate 112 in a direction substantially perpendicular to the rear surface 112*a*. As seen FIG. 13 more specifically, the plate 112 also includes a central post 131, which is formed on the rear surface 112*a* substantially at the center of the array of feed ports 132 to protrude from the surface 112*a* for matching the H plane tee junction together with feed waveguide 122. The second feed ports 132 mentioned earlier extend throughout the radiating waveguide plate 112 in a direction substantially perpendicular to the rear surface 112*a* to the center of radiating waveguides 133, FIG. 14, which will be described later.

Figure 14:
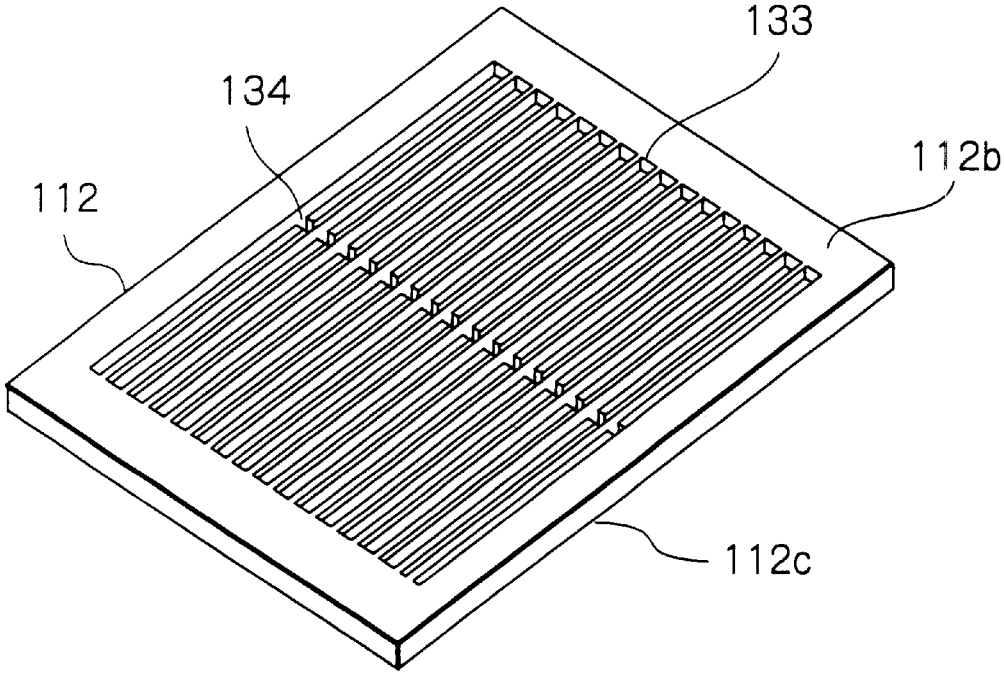
FIG. 14 is a perspective view showing the radiating waveguide plate as seen from the front side thereof.

FIG. 14 shows the front, primary surface 112*b* of the radiating waveguide plate 112. As shown, in the particular, illustrative embodiment, the front surface 112*b* has an array of radiating waveguides 133 cut therein, each extending in the direction substantially parallel to the longer edge 112*c* of the radiating waveguide plate 112. In other words, the radiating waveguides 133 are arranged in a direction substantially perpendicular to the array of second feed ports 132 formed on the rear side to extend at both sides of the array of second feed ports 132. Alternatively, the radiating waveguides 133 may be formed to extend in the direction substantially perpendicular to the longer edge 112*c* of the radiating waveguide plate 112. The number of the radiating waveguides 133 is a multiple of "2" (even number). One feed port 132 is assigned to each of the radiating waveguides 133. When the front surface 111*b* of the feed waveguide plate 111 and the rear surface 112*a* of the radiating waveguide plate 112 are connected together into assembly as shown in FIGS. 19 and 20, each of the matching posts 124 of the former faces one of the second feed ports 132 of the latter. In this condition, the input electromagnetic waves fed into the feed port 121 from the outside feed circuit are efficiently distributed to the second feed ports 132.

Figure 17:
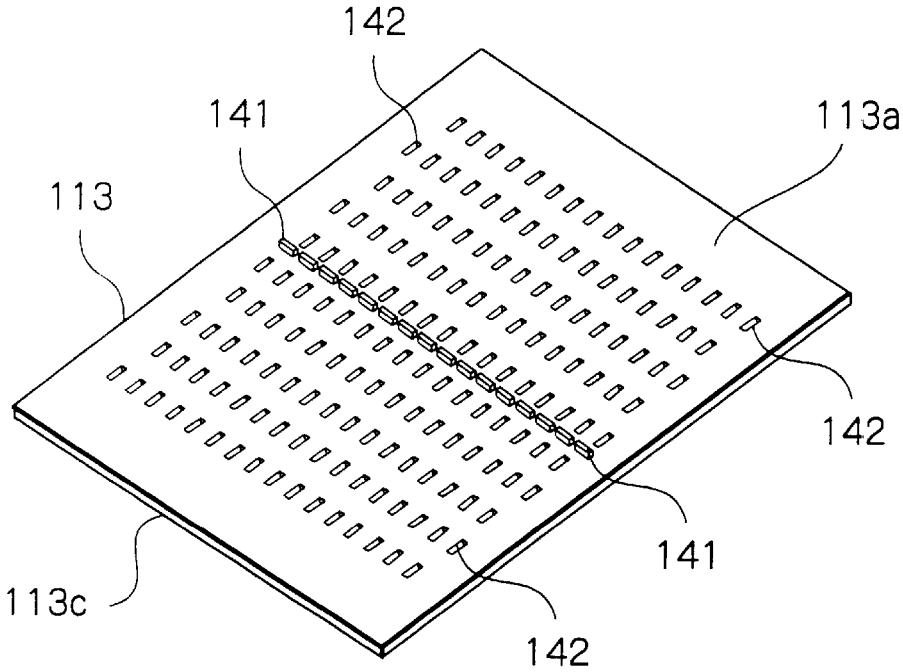
FIG. 17 is a perspective view showing the slot plate further included in the illustrative embodiment, as seen from the rear side thereof.
Figure 18:
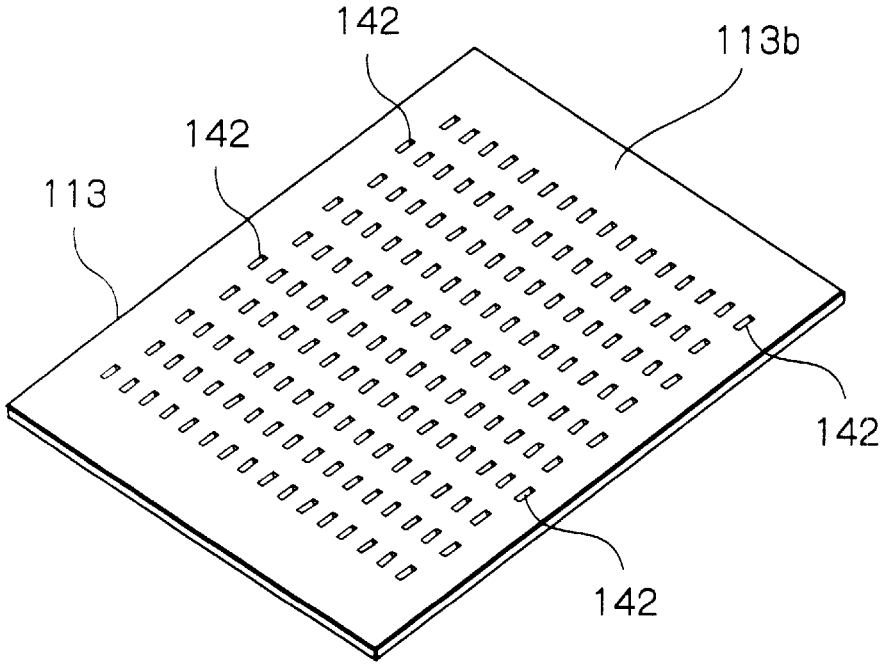
FIG. 18 is a perspective view showing the slot plate as seen from the front side thereof.

Each second feed port 132 is communicated to the center of the entire length of a particular radiating waveguide 133 corresponding thereto. The portion where each of the feed ports 132 and the corresponding one of the radiating waveguides 133 join each other constitutes an E plane tee junction 134. The electromagnetic wave input via each of the feed ports 132 is split into two as to power in the opposite directions of the corresponding one of the radiating waveguides 133 with the phases of the split waves opposite to each other due to the E plane tee junction 134. However, arranging the slots 142 orderly in the slot plate 113 as shown in FIGS. 17 and 18 causes electric and magnetic fields to be distributed uniformly in the same directions at all the slots 142. Specifically, the slots 142 should only be arranged such that the electric or magnetic lines of force flow in the same direction over the entire slot plate 113. The electric or magnetic lines of force can be produced from the position of the E plane tee junction and the guide wavelength.

Figure 15:
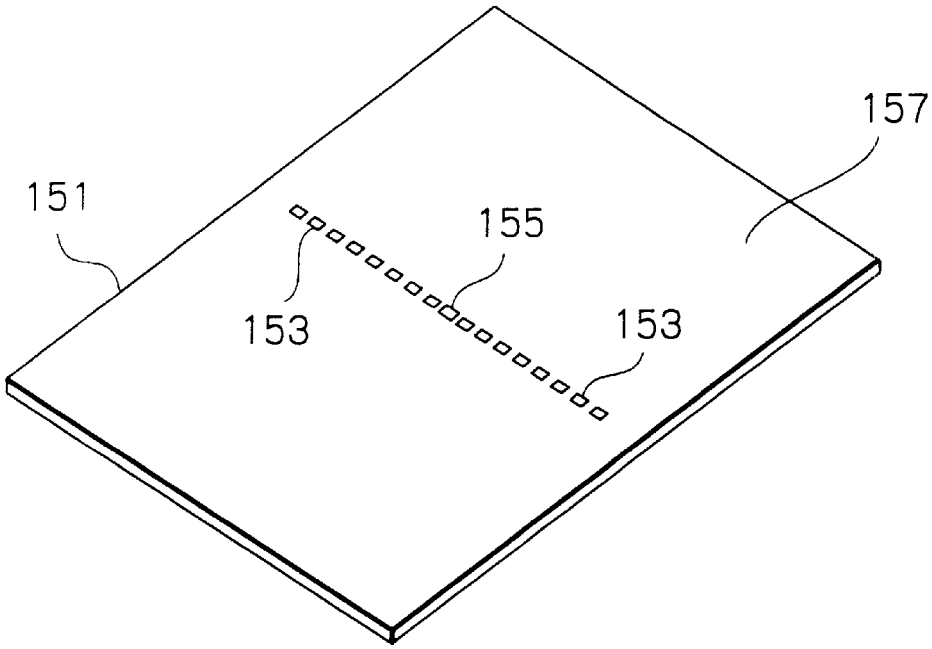
FIGS. 15 and 16 show in perspective views embodiments of an auxiliary plate for use with the radiating waveguide plate.

Each second feed port 132 is sometimes sized smaller than the cross-sectional area of the waveguide for use in the embodiment in order to adjust impedance for design reasons. Specifically, the feed port 132 is sometimes replaced with a feed window. A specific procedure for impedance adjustment will be described hereinafter. For example, an auxiliary conductor plate 151, FIG. 15, may be employed when such impedance adjustment is required. First, the radiating waveguide plate 112 is prepared with the feed ports 132 not reduced in size. Additionally, the auxiliary plate 151 is prepared from a relatively thin sheet of electro-conductive material of the same rectangular shape as the radiating waveguide plate 112. The auxiliary conductive plate 151 is formed with an array of through holes 153 which are identical in number, position and shape with, but sized smaller than, the feed ports 132 for impedance adjustment. The auxiliary plate 151 is then positioned between the front surface 111*b* of the feed waveguide plate 111 and the rear surface 112*a* of the radiating waveguide plate 112. Thereafter, the front surface 111*b* of the feed waveguide plate 111, the auxiliary conductive plate and the rear surface 112*a* of the radiating waveguide plate 112 are connected together. Consequently, each through hole 153 of the auxiliary conductive plate blocks part of the associated feed port 132 and allows the feed port 132 to serve as a feed window for impedance adjustment.

The radiating waveguide plate 112 is formed with the post 131 for matching the H plane tee junction of the feed waveguide plate 111, as stated earlier. The auxiliary conductive plate 151 therefore should not obstruct the function of the post 131 when inserted between the feed waveguide plate 111 and the radiating waveguide plate 112. In light of this, a further through hole 155 is formed in the auxiliary conductive plate 151 at the position corresponding to the post 131 when assembled, to be sized substantially equal to or slightly greater than the post 131 while guaranteeing the impedance adjustment. This allows the post 131 to protrude from the primary surface 157 of the auxiliary conductive plate 151 when the auxiliary plate 151 is bonded to the rear surface 112*a* of the radiating conductive plate 112. The post 131 can therefore serve as a matching stub in the same manner as in the application in which the auxiliary conductive plate 151 is absent.

Figure 16:
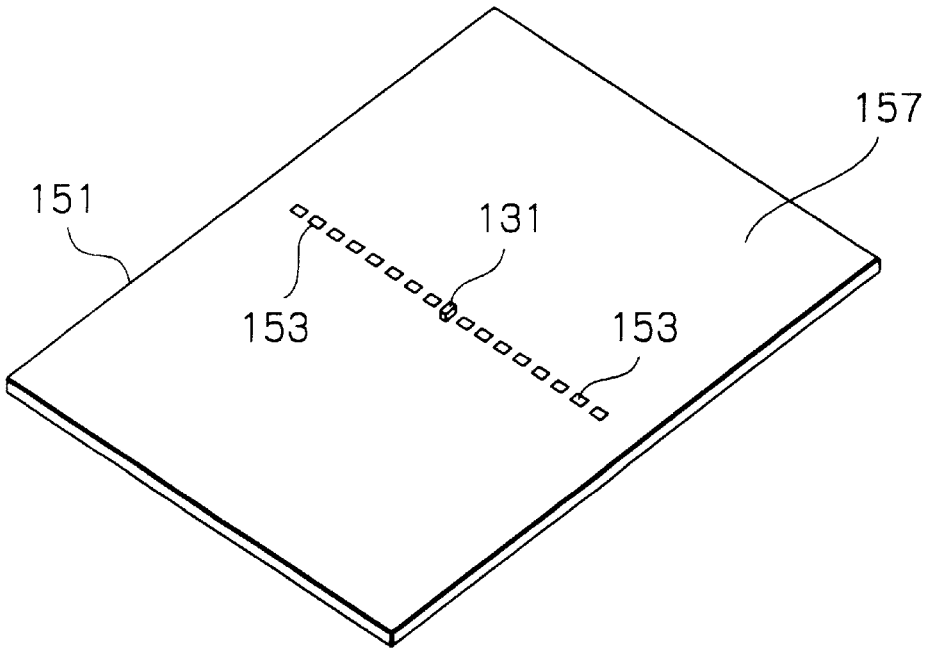

Another specific scheme for guaranteeing the expected function of the post 131 is forming the post 131 not on the rear surface 112*a* of the radiating waveguide plate 112, but on the auxiliary conductive plate 151, as shown in FIG. 16. In this alternative embodiment, when the auxiliary conductive plate 151 modified as above is interconnected to the rear surface 112*a* of the radiating waveguide plate 112 with no post 131 formed, the feed ports 132 of the waveguide plate 112 constitute feed windows while the post 131 for matching the H plane tee junction takes the intended position. This makes it needless to form the auxiliary conductive plate 151 with the through hole 155 for passing the post 131 of the radiating waveguide plate 112.

On the other hand, the auxiliary conductive plate 151 allows the size of each through hole 153, which blocks part of the associated feed port 132, to be freely varied, when designed or assembled, and therefore facilitates impedance adjustment. For this purpose, a plurality of auxiliary conductive plates 151 different in the size of the through hole may be prepared. Appropriate one of the auxiliary conductive plates 151 is selected and inserted between the feed waveguide plate 111 and the radiating waveguide plate 112. Thereafter, the impedance characteristic is measured. That procedure of selection and measurement substantially implements an impedance adjustment and allows optimal one of the auxiliary conductive plates 151 to be selected with a minimum of reflection.

FIGS. 17 and 18 respectively show the rear surface 113*a* and the front surface 113*b* of the slot plate 113. As shown, the slot plate 112 has an array of posts 141 arranged in a direction substantially parallel to the shorter edge 113*c* of the plate 113. In an alternative embodiment, the array of posts 141 may be arranged in a direction substantially perpendicular to the shorter edge 113*c*. The posts 141 protrude from the rear surface 113*a* of the slot plate 113 and play the role of matching stubs for matching the E plane tee junctions 134 of the radiating waveguide plate 112. When the front surface 113*b* of the radiating waveguide plate 112 and the rear surface 113*a* of the slot plate 113 are connected together, each of the posts 141 is positioned substantially at the center of the E plane tee junction 134 of associated one of the radiating waveguides 133 of the waveguide plate 112. The posts 141 are arranged in a transverse array coincident with the transverse array of the E plane tee junctions 134.

Figure 1:
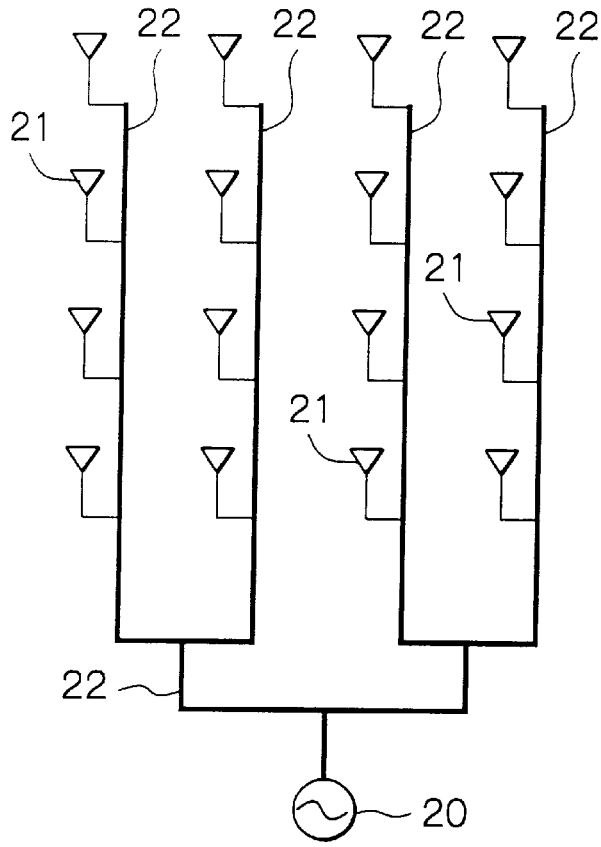
FIG. 1 shows the basic circuit configuration of a conventional, bidimensional array antenna.
Figure 2:
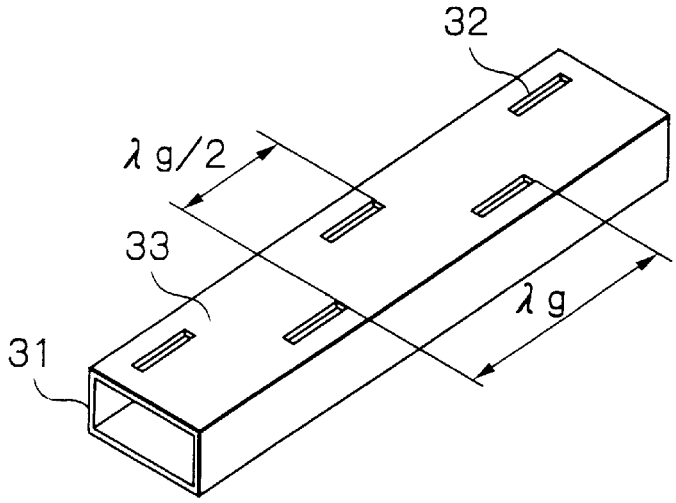
Fig. 2 PRIOR ART
FIG. 2 is a perspective view showing a slot array antenna using a rectangular waveguide tube.
Figure 3:
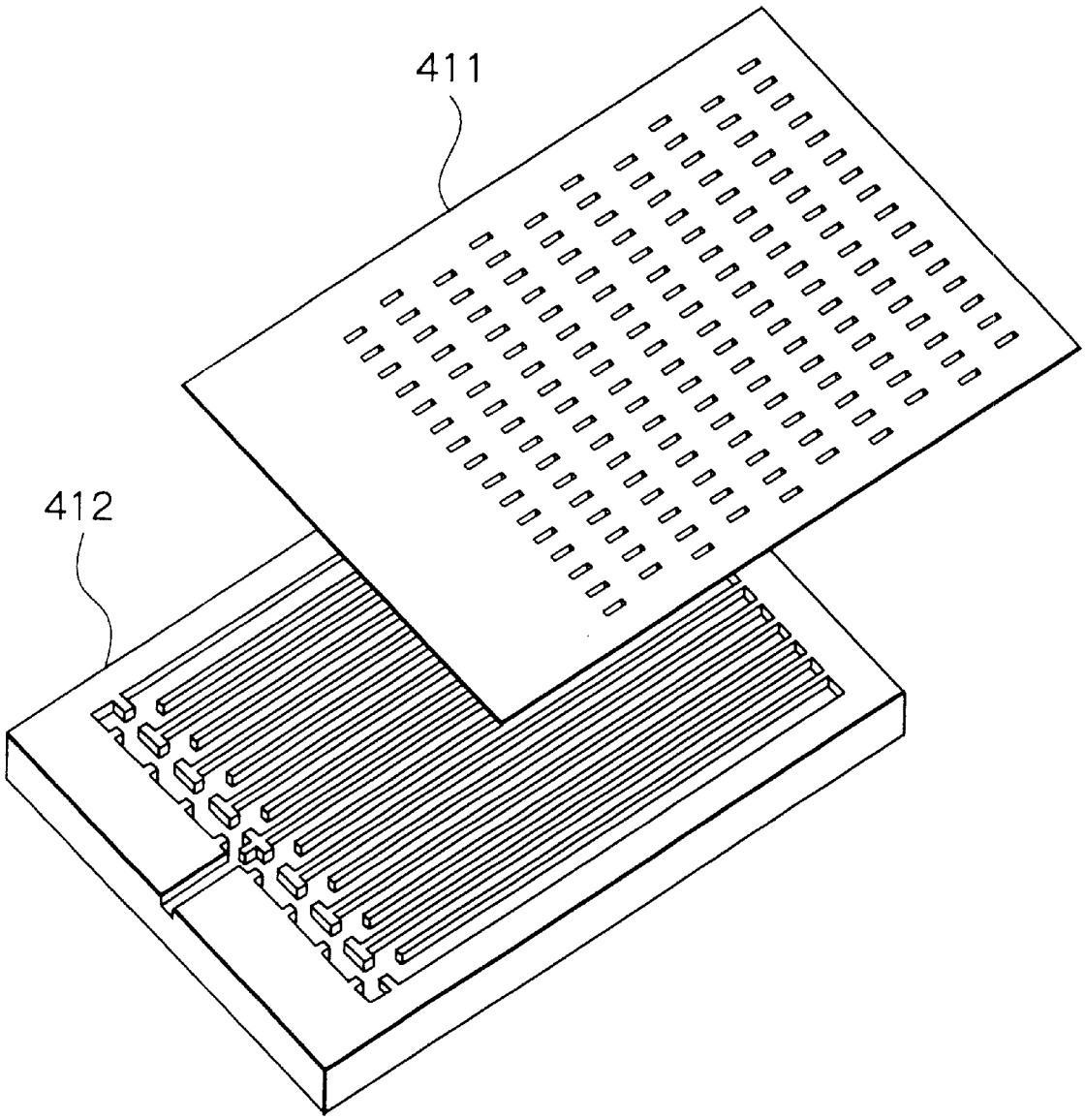
Fig. 3 PRIOR ART
FIG. 3 is an exploded perspective view of a conventional slot array antenna.
Figure 4:
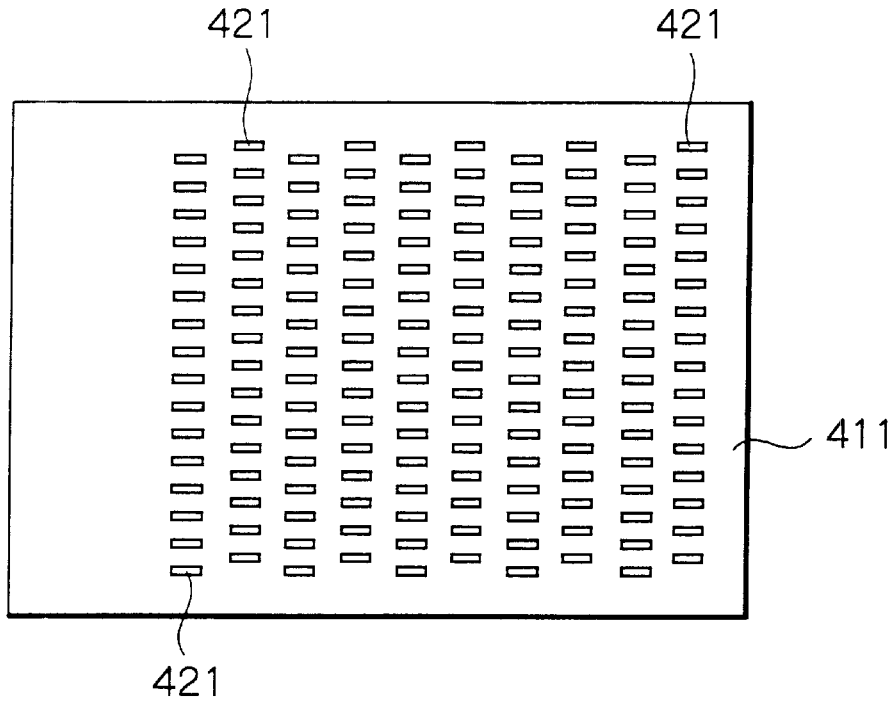
Fig. 4 PRIOR ART
FIG. 4 is a plan view of the slot plate included in the slot array antenna shown in FIG. 3.
Figure 5:
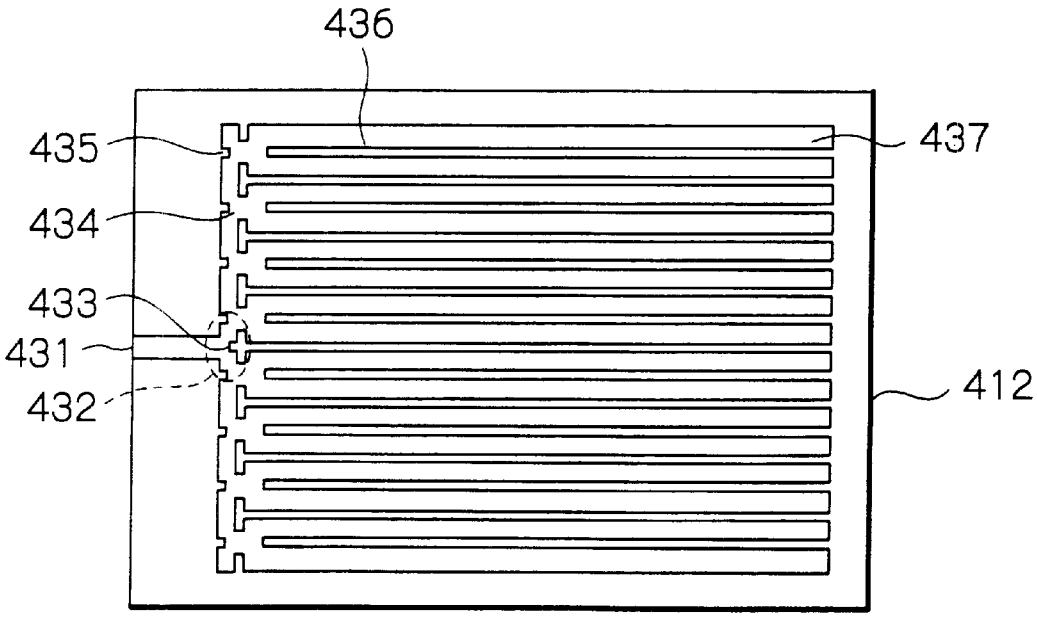
Fig. 5 PRIOR ART
FIG. 5 is a plan view of the waveguide plate also included in the slot array antenna of FIG. 3.
Figure 6:
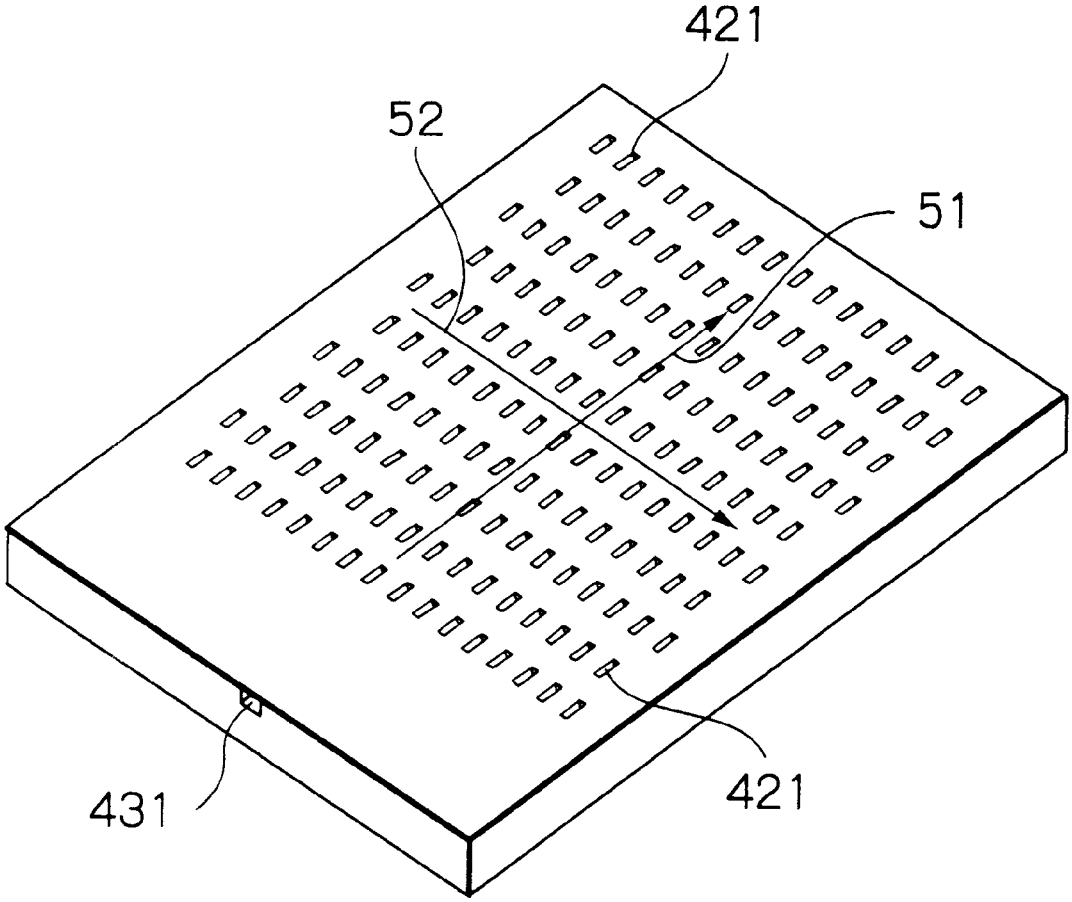
Fig. 6 PRIOR ART
FIG. 6 is a perspective view useful for understanding the polarization directions particular to the conventional slot array antenna.

The slot plate 113 has slots 142 formed in arrays. Each of the arrays of slots 142 runs in a direction substantially perpendicular to the shorter edge 113*c* of the plate 113 and is assigned to particular one of the radiating waveguides 133. In an alternative embodiment, the arrays of slots 142 may be formed to run in a direction substantially parallel to the shorter edge 113*c*. The electromagnetic waves are radiated via the slots 142. Basically, the slots 142 are arranged in the same manner as the slots 421, FIG. 4, of the conventional slot array antenna except that the conventional slots 421 are localized in the right portion in FIG. 4, of the slot plate 411 whereas the slots 142 of the illustrative embodiment are distributed almost or substantially symmetrically with respect to the center of the slot plate 113.

The slot array antenna of the illustrative embodiment is applicable to, e.g., an automotive, anti-collision radar system as transmitter and receiver antennas. Peripheral circuits including a feed circuit are arranged in the axial direction of the first feed port 121. Therefore, when the slot array antenna is rotated or skewed, when installed as needed, the peripheral circuits are skewed on the same axis as the slot array antenna.

In operation, the illustrative embodiment operates almost in the same manner as the conventional slot array antenna except the following points. It is to be noted that the illustrative embodiment performs the following operation only after the feed waveguide plate 111, radiating waveguide plate 112 and slot plate 113 are fully assembled together as shown in FIGS. 19 and 20.

When a dominant mode, electromagnetic wave is fed to the feed port 121, FIG. 20, the H plane tee junction 123 splits the wave into two as to power. The resulting two electromagnetic waves of the same phase are distributed to the both parts of the feed waveguide 122 in the opposite directions. At this instant, the matching post 131, FIG. 11, reduces a loss ascribable to a mismatching at the H plane tee junction 123. The electromagnetic waves are then distributed to the radiating waveguides 133 via the feed ports 132, which are formed in the rear surface 112*a* of the radiating waveguide plate 112 and equal in number to the waveguides 133. The radiating waveguide plate 112 forms the top wall of the feed waveguide 122. The posts 124 each facing one of the feed ports 132 successfully reduces a loss ascribable to a mismatching then encountered. Consequently, the electromagnetic wave introduced via the feed port 121 efficiently propagates to the radiating waveguides 133 via the feed waveguide 122 and feed ports 132.

Each feed port 132 forms the E plane tee junction 134 in cooperation with the central portion of the associated radiating waveguide 133. As a result, the electromagnetic wave conducted via the feed port 132 is split into two as to power in the opposite directions with respect to the feed port 132. However, the split waves are opposite in phase to each other because of the E plane tee junction. At this instant, the matching post 141 protruding from the rear surface 113*a* of the slot plate 113 at each E plane tee junction 134 reduces a loss ascribable to a mismatching appearing at the feed port 132.

By the way, the slots 142 are adapted to be, when the slot plate 113 is bonded with the radiating waveguide plate 112 to cover the grooves 133, positioned on the front surface 113*b* side of the slot array antenna to form one of the walls of the radiating waveguides 133. Further, the slots 142 are positioned such that electromagnetic fields are established in the same direction in the plane where the slots 142 are open, i.e., such that the electric or magnetic lines of force flow in the same direction. Consequently, electromagnetic field sources of the same direction are distributed, although discretely, on the front surface 113*b* of the slot array antenna. It is therefore possible to radiate intense electromagnetic waves from the front surface 113*b* to a particular remote place in dependent upon the size and arrangement of the slots 142. Stated another way, the electromagnetic wave provided via the feed port 121 is efficiently transferred to a particular remote place via the slot array antenna.

If the entire apparatus should be skewed in order to adjust the polarization direction, as is the case with an automotive anti-collision radar system, then the slot array antenna may appropriately be skewed. Although the peripheral circuits including a feed circuit are skewed together with the slot array antenna, they are skewed about on the central axis of the antenna, substantially perpendicular to the front surface 113*b*, and therefore need a minimum of space for skewing.

While the slot array antenna has been shown and described as implementing a transmitter antenna, it may, of course, implement a receiver antenna.

Generally, since the principle of reciprocity can apply to all kinds of antenna, the transmitting characteristics and receiving characteristics of an antenna are identical with each other. While the foregoing description has concentrated on transmitting, the procedure shown and described is reversed when receiving. Therefore, if a receiving device including a receiver circuit is connected to the feed port 121, then the slot array antenna functions as a receiver antenna. In this case, weak electromagnetic waves input to the radiating waveguides 133 are sequentially propagated via the second feed ports 132 and feed waveguide 122. Consequently, the electromagnetic waves are matched to each other to be intensified and output to the receiving device via the first feed port 121. The receiving device coupled to the slot array antenna in accordance with the invention can therefore efficiently receive weak electromagnetic waves and also an electromagnetic wave arriving in a particular direction.

As stated above, in the illustrative embodiment, the first feed port is positioned at the center of the rear surface 111*a* of the slot array antenna. This allows the entire antenna to be rotated or skewed about the axis of the first feed port 121, substantially perpendicular to the rear surface 111*a*, in order to adjust the polarization direction thereof. More specifically, a desired polarization direction of the antenna can be set without any noticeable change in the positions or orientations of peripheral circuits including a feed circuit. This advantage is not achievable with the conventional slot array antenna. The peripheral circuits can therefore be skewed about the axis of the feed port 121 together with the antenna, needing a minimum of additional space and thereby miniaturizing the antenna system.

When the illustrative embodiment is applied to an automotive anti-collision radar system capable of easily adapting to any polarization direction, it contributes a great deal to the miniaturization of the radar system.

Further, the conventional, bidimensional slot array antenna has radiating waveguides the number of which is a multiple of "4" without exception. By contrast, the illustrative embodiment has radiating waveguides the number of which is a multiple of "2". The illustrative embodiment therefore promotes free design more than conventional and reduces the overall size of the slot array antenna.

In the illustrative embodiment the first feed port 121 is accurately positioned at the center of the feed waveguide plate 111. The crux is that the feed port 121 be accurately positioned at the center of the entire length of the feed waveguide 122. This means that the feed port 121 may be offset from the center of the feed waveguide plate 111 to some extent. More specifically, the feed waveguide 122 may be suitably shifted relative to the feed waveguide plate 111 in order to adjust the position of the feed port 121, so that the feed port 121 aligns with the axis of the skew of the peripheral circuits. This is successful to further reduce the wasteful space.

The illustrative embodiment is applicable not only to an automotive anti-collision radar system, but also to an antenna for ITS or ETC (Electronic Toll Collection system).

Moreover, by increasing the number of slots, it is possible to further enhance the radiation gain and to further sharpen the main beam radiated. This allows the illustrative embodiment to be implemented as a high-gain antenna comparable to, e.g., a parabola antenna. For example, the illustrative embodiment can be implemented as transit antennas for use in base stations of telecommunications and television systems, and as antennas for use in satellite communications and radio telescopes.

In summary, it will be seen that the present invention provides a slot array antenna having various unprecedented advantages as enumerated below.

(1) Even when the antenna is skewed, peripheral circuits including a feed circuit are not noticeably shifted. The antenna therefore reduces a wasteful space otherwise allotted to the peripheral circuits and therefore minimizes the size of the entire apparatus in which it is included.

(2) The feed windows are adjustable in size and allow impedance to be adjusted. This may be done by selectively mounting a plurality of auxiliary conductive plates different in the size of the feed windows from each other.

(3) The number of the radiating waveguides is a multiple of "2" and thus promotes free design.

The entire disclosure of Japanese patent application No. 2001-19945 filed on Jan. 29, 2001, including the specification, claims, accompanying drawings and abstract of the disclosure is incorporated herein by reference in its entirety.

While the present invention has been described with reference to the particular illustrative embodiment, it is not to be restricted by the embodiment. It is to be appreciated that those skilled in the art can change or modify the embodiment without departing from the scope and spirit of the present invention.

What is claimed is:

1. A slot array antenna comprising:

a first plate of electro-conductive material having a first and a second primary surface;

a second plate of electro-conductive material having a third and a fourth primary surface;

a third plate of electro-conductive material having a fifth and a sixth primary surface;

said first plate including:

a first feed port open to the first primary surface and formed substantially perpendicularly to the first primary surface for receiving an electromagnetic wave; and a feed waveguide formed in the second primary surface and communicating with said first feed port substantially at a center of a length of said feed waveguide for distributing the electromagnetic wave conducted from said first feed port;

said second plate including:

an array of second feed ports open to the third primary surface and formed substantially perpendicularly to the third primary surface, each of said second feed ports receiving a particular electromagnetic wave distributed by said feed waveguide; and an array of radiating waveguides formed in the fourth primary surface, each of said radiating waveguides being formed in a direction substantially perpendicularly to said array of second feed ports to communicate with associated one of said second feed ports and feeding the particular electromagnetic wave provided from said one second feed port;

said third plate having arrays of slots formed from the fifth and sixth primary surfaces, each of said arrays being disposed over a length of associated one of said radiating waveguides;

said first, second and third plates being accumulated with the second and third primary surfaces, and the fourth and fifth primary surfaces connected respectively.

2. The slot array antenna in accordance with claim 1, further comprising a fourth plate of electro-conductive material and having an array of feed windows formed correspondingly in position to said second feed ports, said feed windows being smaller in size than said second feed ports to adjust impedance of said second feed ports, said fourth plate being disposed on the third primary surface.

3. The slot array antenna in accordance with claim 1, wherein a number of said radiating waveguides is a multiple of "2".

4. The slot array antenna in accordance with claim 1, wherein said first, second and third plates are generally flat.

5. The slot array antenna in accordance with claim 1, wherein said first, second and third plates are of a rectangular shape of the same size as each other.

6. The slot array antenna in accordance with claim 2, wherein said fourth plate is generally flat.

7. A slot array antenna comprising:

a feed waveguide plate of electro-conductive material formed with a first feed port to which an electromagnetic wave is input, and a feed waveguide for distributing the electromagnetic wave input via said first feed port;

a radiating waveguide plate of electro-conductive material formed with an array of second feed ports to each of which a particular electromagnetic wave distributed by said feed waveguide is input, and arrays of radiating waveguides each being communicated to one of said second feed ports for receiving the particular electromagnetic wave; and a slot plate of electro-conductive material formed with arrays of slots for radiating electromagnetic waves input via said arrays of radiating waveguides;

said first feed port being positioned substantially at a center of a length of said feed waveguide, said feed waveguide plate having a front surface connected to a rear surface of said radiating waveguide plate while said radiating waveguide plate has a front surface connected to a rear surface of said slot plate.

8. The slot array antenna in accordance with claim 7, wherein said feed waveguide plate is formed with an H plane tee junction at a portion where said first feed port and said feed waveguide join each other, and an even number of first matching posts protruding from a wall of said feed waveguide which has said first feed port formed, each of said first matching posts facing one of said second feed ports to serve as a matching stub;

said second feed ports and said radiating waveguides being identical in number with said matching posts;

said radiating waveguide plate having E plane tee junctions formed at portions where said second feed ports and said arrays of radiating waveguides join each other;

said radiating waveguide plate having a second matching post protruding from said radiating waveguide plate and facing said first feed port to serve as a matching stub for the H plane tee junction of said feed waveguide;

said slot plate having an array of third matching posts identical in number with said arrays of radiating waveguides and protruding from the rear surface of said slot plate for serving as matching stubs for the E plane tee junctions, each of said arrays of slots being substantially uniformly distributed over a length of associated one of said radiating waveguides.

9. The slot array antenna in accordance with claim 7, further comprising an array of feed windows formed over said second feed ports, each of said feed windows intervening between said feed waveguide and associated one of said arrays of radiating waveguides, and being smaller in size than said second feed ports to adjust impedance of said second feed ports.

10. The slot array antenna in accordance with claim 7, further comprising an auxiliary plate of electro-conductive material having an array of feed windows formed through said auxiliary plate, said auxiliary plate intervening between said feed waveguide plate and said radiating waveguide plate, said auxiliary conductive plate blocking part of each of said second feed ports to thereby form associated one of said feed windows to adjust impedance of said second feed ports.

11. The slot array antenna in accordance with claim 10, wherein said auxiliary plate is formed with a matching post for an H plane tee junction of said feed waveguide plate.

12. The slot array antenna in accordance with claim 10, wherein said auxiliary plate is generally flat.

13. The slot array antenna in accordance with claim 7, wherein a number of said radiating waveguides is a multiple of "2".

14. The slot array antenna in accordance with claim 7, wherein said feed waveguide plate, radiating waveguide plate and slot plate are generally flat.

15. The slot array antenna in accordance with claim 7, wherein said feed waveguide plate, radiating waveguide plate and slot plate are of a rectangular shape of the same size as each other.

16. A slot array antenna having a generally flat plate-like structure of a generally rectangular shape, wherein said plate-like structure has a first primary surface and a second primary surface opposite to the first primary surface, said first primary surface having a first feed port formed substantially at a center of the first primary surface for receiving an electromagnetic wave, the first feed port being of a generally rectangular cross section having sides thereof substantially parallel to corresponding sides of the generally rectangular shape, said second primary surface having arrays of slots formed bidimensionally over and in the second primary surface and interconnected to the first feed port for radiating the electromagnetic wave received by the first feed port.

17. The slot array antenna in accordance with claim 16, wherein said plate-like structure comprises:

a generally flat, rectangular feed waveguide plate of electro-conductive material formed with the first feed port and a feed waveguide for distributing the electromagnetic wave input via the first feed port;

a generally flat, rectangular radiating waveguide plate of electro-conductive material formed with an array of second feed ports to each of which a particular electromagnetic wave distributed by said feed waveguide is input, and arrays of radiating waveguides each communicated to one of the second feed ports for receiving the particular electromagnetic wave; and a generally flat, rectangular slot plate of electro-conductive material formed with the arrays of slots for radiating electromagnetic waves input via the arrays of radiating waveguides;

said feed waveguide plate having a front surface connected to a rear surface of said radiating waveguide plate, said radiating waveguide plate having a front surface connected to a rear surface of said slot plate.

18. The slot array antenna in accordance with claim 17, wherein the first feed port is positioned substantially at a center of a length of said feed waveguide.

19. The slot array antenna in accordance with claim 18, wherein said feed waveguide plate is formed with an H plane tee junction at a portion where the first feed port and said feed waveguide join each other, and an even number of first matching posts protruding from a wall of said feed waveguide which has the first feed port formed, each of said first matching posts facing one of the second feed ports to serve as a matching stub;

the second feed ports and said radiating waveguides being identical in number with said matching posts;

said radiating waveguide plate having E plane tee junctions formed at portions where the second feed ports and said arrays of radiating waveguides join each other;

said radiating waveguide plate having a second matching post protruding from said radiating waveguide plate and facing the first feed port to serve as a matching stub for the H plane tee junction of said feed waveguide;

said slot plate having an array of third matching posts identical in number with said arrays of radiating waveguides and protruding from the rear surface of said slot plate for serving as matching stubs for the E plane tee junctions, each of said arrays of slots being substantially uniformly distributed over a length of associated one of said radiating waveguides.

20. The slot array antenna in accordance with claim 18, further comprising an array of feed windows formed over the second feed ports, each of said feed windows intervening between said feed waveguide and associated one of said arrays of radiating waveguides, and being smaller in size than the second feed ports to adjust impedance of said second feed ports.

21. The slot array antenna in accordance with claim 18, further comprising a generally flat auxiliary plate of electro-conductive material having an array of feed windows formed through said auxiliary plate, said auxiliary plate intervening between said feed waveguide plate and said radiating waveguide plate, said auxiliary conductive plate blocking part of each of the second feed ports to thereby form associated one of said feed windows to adjust impedance of the second feed ports.

22. The slot array antenna in accordance with claim 21, wherein said auxiliary plate is formed with a matching post for an H plane tee junction of said feed waveguide plate.

23. The slot array antenna in accordance with claim 18, wherein a number of said radiating waveguides is a multiple of "2".

* * * * *